US006419566B1

(12) United States Patent
Palmisano

(10) Patent No.: US 6,419,566 B1
(45) Date of Patent: Jul. 16, 2002

(54) SYSTEM FOR CLEANING CONTAMINATION FROM MAGNETIC RECORDING MEDIA ROWS

(75) Inventor: Richard I. Palmisano, San Martin, CA (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/502,883

(22) Filed: Feb. 11, 2000

(51) Int. Cl.[7] ..... B24C 3/32; B24C 3/04
(52) U.S. Cl. ..... 451/78; 90/99; 90/102
(58) Field of Search ..... 451/38, 39, 41, 451/102, 40, 60, 99, 100, 75, 78, 90

(56) References Cited

U.S. PATENT DOCUMENTS

| | | | | |
|---|---|---|---|---|
| 4,412,402 A | * | 11/1983 | Gallant | 451/102 |
| 5,325,566 A | * | 7/1994 | Jahani | 15/302 |
| 5,409,418 A | * | 4/1995 | Krone-Schmidt et al. | 451/102 |
| 5,412,910 A | * | 5/1995 | Woodson et al. | 451/38 |
| 5,442,850 A | | 8/1995 | Kerth | |
| 5,487,695 A | * | 1/1996 | Shank | 451/102 |
| 5,533,922 A | * | 7/1996 | Yamaharu | 451/38 |
| 5,643,472 A | | 7/1997 | Engelsbert et al. | |
| 5,651,834 A | * | 7/1997 | Jon et al. | 451/78 |
| 5,916,424 A | | 6/1999 | Libby et al. | |

FOREIGN PATENT DOCUMENTS

| | | |
|---|---|---|
| JP | 09-171985 | 6/1997 |
| JP | 09-171986 | 6/1997 |
| JP | 11-025437 A | 1/1999 |

* cited by examiner

*Primary Examiner*—M. Rachuba
(74) *Attorney, Agent, or Firm*—Robert B. Martin; Bracewell & Patterson, L.L.P.

(57) ABSTRACT

A system having an array of nozzles is used to clean fabricated rows of magnetic heads. Each nozzle contains a pair of concentric tubes. The inner tube of the nozzle discharges a plume of fine dry material at a target. The outer tube of the nozzle simultaneously discharges a hollow tube of water that completely surrounds the plume discharged by the inner tube. This nozzle design prevents the dry material from mixing with the water during discharge so that the plumes remain dry until they strike the target with the tubes of water. As the nozzles pass over various portions of the target, the plumes remove most forms of process contamination, while the water serves multiple purposes. The leading stream of water in front of each plume loosens some contaminants and moistens the target prior to contact by the dry material. In addition, the trailing streams of water flush the target and removes any remaining contamination left behind after the plumes pass by. The tube of water for each nozzle also reduces dry powder overspray or dust and provides ESD protection for the target. A final rinse with a set of fan nozzles removes any residual contamination and/or cleaning media.

14 Claims, 2 Drawing Sheets

SYSTEM FOR CLEANING CONTAMINATION FROM MAGNETIC RECORDING MEDIA ROWS

BACKGROUND OF THE INVENTION

1.Technical Field

This invention relates in general to processing magnetic recording media during fabrication, and in particular to an ESD-sensitive, corrosion-free system for cleaning all types of contamination from the surfaces of rows of magnetic recording media while fabricating the rows into magnetic read/write heads.

2. Description of Related Art

During the fabrication of thin film, magnetic read/write heads for magnetic recording applications, the heads are formed from a continuous row on a media wafer.

Each wafer typically contains hundreds of rows, and each row may produce hundreds of heads. The rows are processed from the wafer prior to being segmented into the individual heads. The rows must undergo thorough and difficult cleaning processes prior to each of the critical fabrication steps, only a few of which are described above.

There are at least two major factors that contribute to the difficulty of cleaning rows. The first factor is the complex topography of the rows. Each of the heads on each row has a very precise air bearing surface (ABS) pattern that has been reactive ion etched (RIE) or ion milled thereon. ABS comprise intricate three-dimensional contours on the side of a head that will fly adjacent to a disk. The second factor is the assortment of surface present on the rows during the various fabrication steps. Contaminations such as particulates, stains, adhesives, residual photo resist, laser slag, and chemical and/or environmental contaminants are common.

Current cleaning technology employs several different cleaning strategies, including high or low pressure sprays, mechanical brushes, ultrasonic or megasonic baths, hand spot cleaning, acoustic cleaning, carbon dioxide (CO2) or snow cleaning, and chemical cleaning. Unfortunately, no combination of cleaning techniques will consistently remove all types of contamination. Moreover, some types of cleaning tend to create or conduct electrostatic discharge (ESD). ESD can damage or destroy the rows and future heads if it is not controlled during cleaning. In addition, some cleaning strategies are very aggressive and/or abrasive, thereby mechanically damaging the row and/or corroding the device, thereby destroying the head surfaces and/or the head electronics. Thus, there is a need to develop a high through-put, non-contact cleaner that consistently will remove all process contamination from the product without causing incidental damage to the product.

SUMMARY OF THE INVENTION

A system having an array of nozzles is used to clean fabricated rows of magnetic heads. Each nozzle contains a pair of concentric tubes. The inner tube of the nozzle discharges a plume of fine dry material at a target. The outer tube of the nozzle simultaneously discharges a hollow tube of water that completely surrounds the plume discharged by the inner tube. This nozzle design prevents the dry material from mixing with the water during discharge so that the plumes remain dry until they strike the target with the tubes of water. As the nozzles pass over various portions of the target, the plumes remove most forms of process contamination, while the water serves multiple purposes.

The leading stream of water in front of each plume loosens some contaminants and moistens the target prior to contact by the dry material. In addition, the trailing streams of water flush the target and removes any remaining contamination left behind after the plumes pass by. The tube of water for each nozzle also reduces dry powder overspray or dust and provides ESD protection for the target. A final rinse with a set of fan nozzles removes any residual contamination and/or cleaning media.

Accordingly, it is an object of the present invention to provide an improved cleaning system.

It is an additional object of the present invention to provide processing of magnetic recording media during fabrication.

It is yet another object of the present invention to provide an ESD-sensitive, corrosion-free system for cleaning all types of contamination from the surfaces of of magnetic recording media while fabricating the rows into magnetic read/write heads.

The foregoing and other objects and advantages of the present invention will be apparent to those skilled in the art, in view of the following detailed description of the preferred embodiment of the present invention, taken in conjunction with the appended claims and the accompanying drawings.

DESCRIPTION OF THE DRAWINGS

So that the manner in which the features, advantages and objects of the invention, as well as others which will become apparent, are attained and can be understood in more detail, more particular description of the invention briefly summarized above may be had by reference to the embodiment thereof which is illustrated in the appended drawings, which drawings form a part of this specification. It is to be noted, however, that the drawings illustrate only a preferred embodiment of the invention and is therefore not to be considered limiting of its scope as the invention may admit to other equally effective embodiments.

MODE FOR CARRYING OUT THE INVENTION

Figure 1:
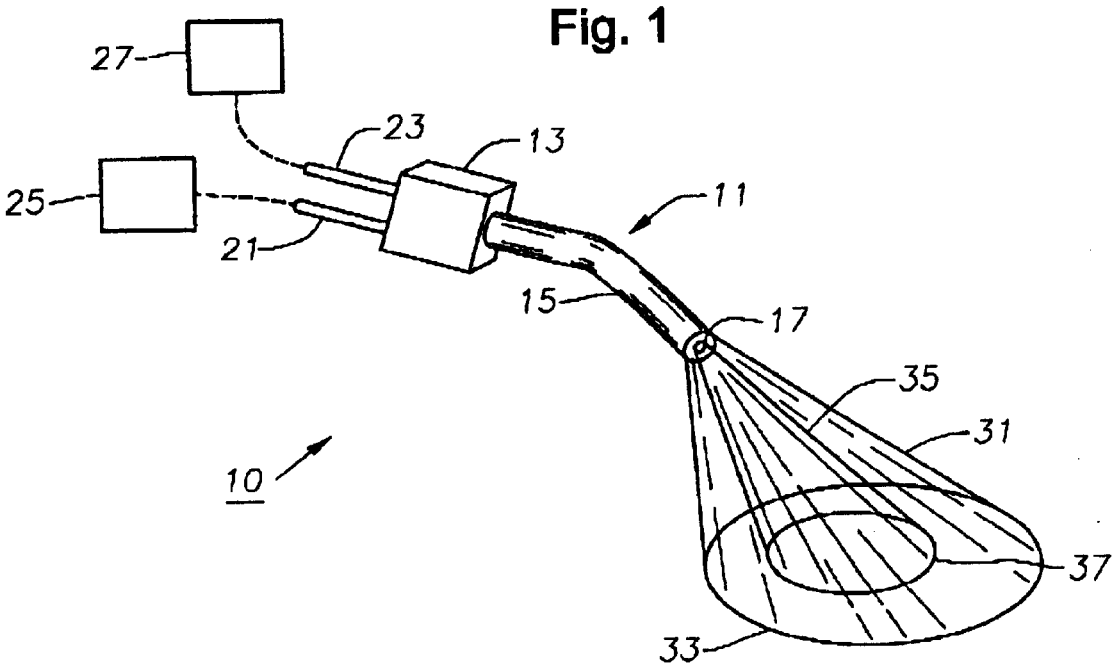
FIG. 1 is a schematic isometric view of a cleaning nozzle constructed accordance with the invention.

Referring to FIG. 1, a wet/dry media cleaning system 10 is shown. Cleaning system 10 has a nozzle 11 for discharging matter to clean contamination from a target. Nozzle 11 comprises a base 13, an outer tube 15 extending in a downstream direction from base 13, and an inner tube 17 concentrically mounted within outer tube 15, also extending from base 13 in said downstream direction. The downstream ends of outer and inner tubes 15, 17 each terminate in a small discharge orifice for ejecting their respective contents. The discharge orifices are concentric with each other. Outer tube 15 is designed for fluid discharge, while inner tube 17 is designed with small orifice sandblasting technology for solid matter discharge.

A pair of inlet ports 21, 23 also extend from base 13 in an upstream direction. Ports 21, 23 are fluidically interconnected with the upstream ends of outer and inner tubes 15, 17, respectively. Port 21 is joined to a liquid source 25 having a reservoir of liquid and a pump. In the embodiment shown, liquid source 25 contains deionized water.

Preferably, a surfactant such as LIQUINOX®, carbon dioxide, or an equivalent additive, is metered into the deionized water to make it conductive and reduce or eliminate the risk of electrostatic discharge damage to the target. A critical issue is to meter a given amount of additive into the fluid, thereby insuring complete mixing of the fluid at a uniform controlled rate. Rather than using fluid pumps that spike a concentration of additive into the fluid to provide non-uniform concentrations, two alternatives are proposed. A storage tank of pre-mixed solution of the correct specification may be used, or an in-line pump and mix chamber within the fluid system to allow for complete mixing prior to discharge.

Port 23 is joined to a media source 27 containing a volume of dry material. Media source 27 contains a fine, dry, powdery substance that is designed for each particular cleaning application. Factors contributing to the design of the material in media source 27 include particle shape, particle size distribution, material base, flowability, density, particle shape, purity, moisture content, and desired velocity from the orifice of inner tube 17. The media material and critical parameters are chosen for their ability to remove required contaminants without damaging the target. In the preferred embodiment, an industry standard media such as pure bicarbonate of soda is used. In particular, the media has a minimum purity of 99% with no flow aid as defined by USP. The mean particle size is 75 $\mu$m with a standard deviation of 15 $\mu$m. The particles of the media are approximately 80% single crystals and 20% conglomerate crystals.

As shown in FIG. 1, nozzle 11 delivers two independent streams of discharge. Outer tube 15 expels a hollow, conical water projection or tube 31 having a generally annular cross-sectional shape 33 with a central void. Ideally, the fluid is discharged as a low pressure spray (5–100 psig) at 50 ml per minute. Inner tube 15 discharges a substantially solid, conical dispersion or plume 35 of the dry matter in a generally circular cross-sectional shape 37. Plume 35 is located completely within the central void of water tube 31 such that its dry matter does not mix with the water during discharge from nozzle 11, other than incidental contact. It is only after contact with the target that plume 35 mixes with water 31.

The main task of the system 10 is to deliver the dry media from a supply tank to nozzle 11 while maintaining a uniform cross-sectional density and flow rate without altering the particle's critical parameters.

Additionally, system 10 is required to ensure no blockage in nozzle 11. Media source 27 is selected for its ability to monitor the flow rate and/or density and meter 10 the media most reliably. Additional subsystems for bleeding air, filtering clean dry air (CDA) from a heatless compressed gas dryer, and electronically controlling the media density monitoring device are also used. Important process parameters include control of dew point for the CDA (moisture content), CDA pressure transporting the media, nozzle delivery pressure, material metering orifice size, the monitoring device and sensitivity settings for cross-sectional density, splitter design and delivery system design and routing to prevent media critical parameter changes.

Figure 2:
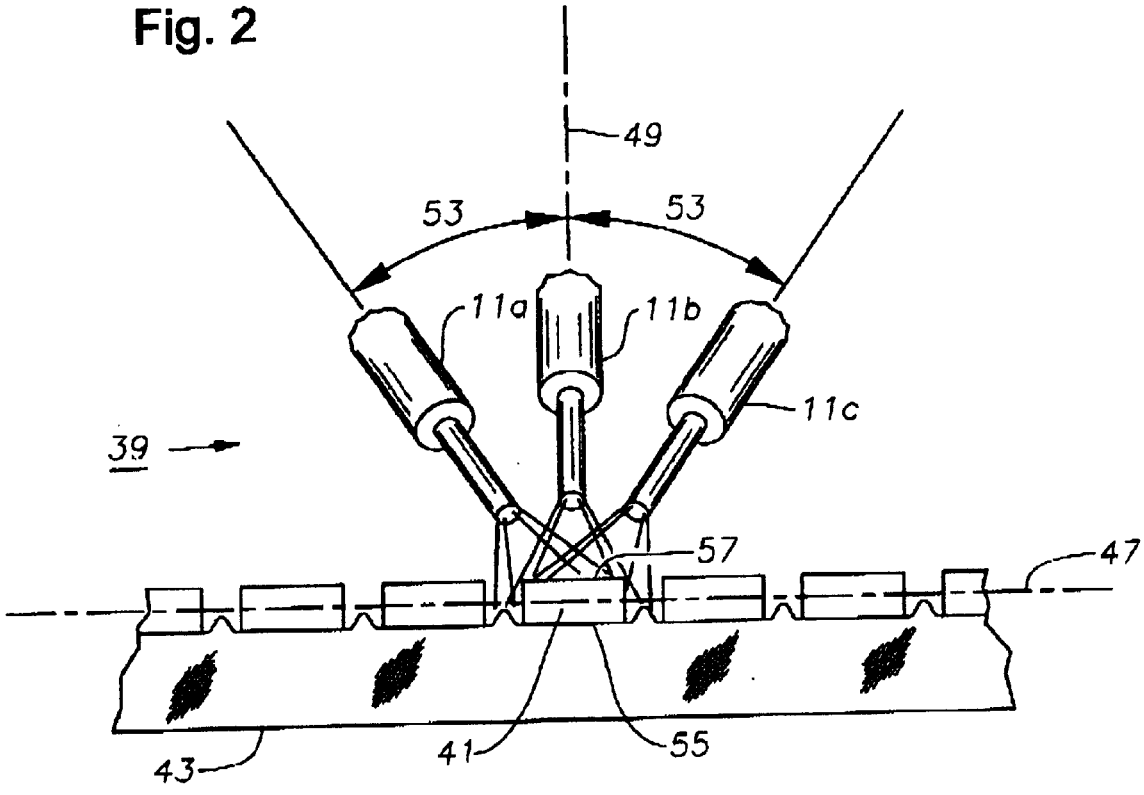
FIG. 2 is a schematic front view of an array of the cleaning nozzles of FIG. 1 in operation.

In operation, cleaning system 10 may use one nozzle 11 singularly (FIG. 1) for relatively simple cleaning applications, or a plurality or array 39 of multiple nozzles 11 (FIG. 2) for more complex cleaning applications. The number of nozzles 11 that may be provided in array 39 or sets of arrays 39 is virtually unlimited. For simplicity, an example of a cleaning application requiring one array 39 of three nozzles 11*a*, 11*b*, 11*c* is shown in FIGS. 2 and 3.

Figure 3:
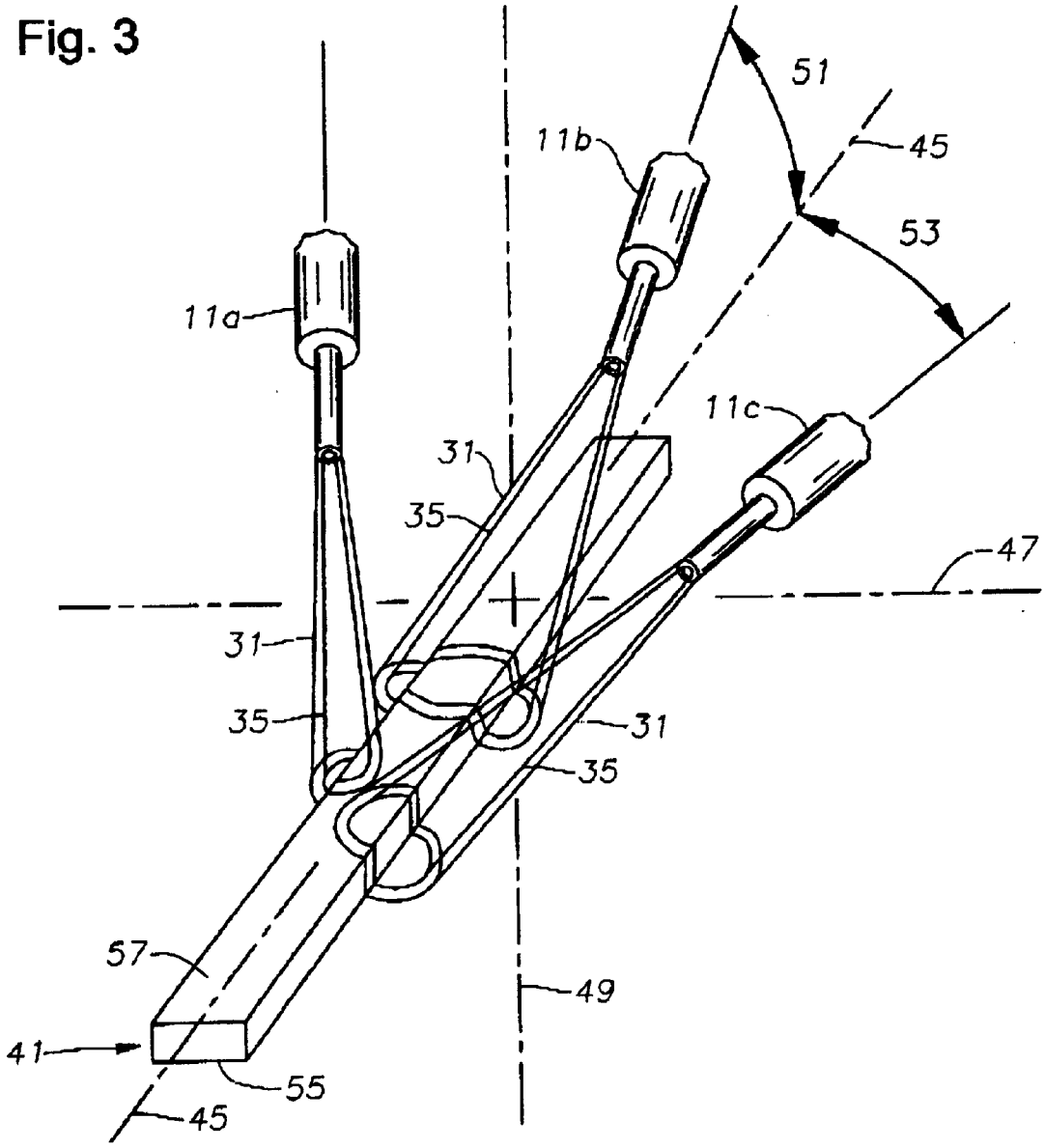
FIG. 3 s a schematic isometric view of the array cleaning nozzles o FIG. 2 in operation.

Nozzles 11 may be oriented at various angles relative to a set of targets, such as magnetic media rows 41 (one shown in FIG. 3). Rows 41 are used to form magnetic read/write heads, and are placed in a mounting 43 (FIG. 2) to keep them stationary relative to array 39. Each row 41 has a generally rectangular, block-like shape with six sides, a longitudinal axis 45, a lateral axis 47, and a vertical axis 49. In the embodiment shown, each nozzle 11*a*, 11*b*, 11*c* is vertically offset by an angle 51 (approximately 45 degrees) from the horizontal plane defined by axes 45, 47. This configuration centers nozzle 11*a*, 11*c* along axes 45, 49. In addition, nozzles 11*a* and 11*c* are also offset by an angle 53 (also approximately 45 degrees) from the vertical plane defined by axes 45, 49. Thus, nozzles 11*a*, 11*c* are symmetrically positioned on the lateral sides of nozzle 11*b* toward row 41 and do not vary from their orientations.

The side 55 of each row 41 adjacent to fixture 43 is inaccessible to the discharge of nozzles 11 due to the presence of fixture 43. The five remaining sides of each row 41 are completely exposed to nozzles 11 for cleaning by the system. In this example, side 57 of each row 41 opposite to fixture 43 has intricate surface detail such as air bearing surfaces for each of the magnetic heads that will be formed from row 41. The tip of each nozzle 11 is located approximately one inch away from the current row 41. In the orientation shown, nozzle 11*a* primarily targets the left portions of row 41, nozzle 11*b* targets the top of row 41, and nozzle 11*c* targets the right portions of row 41. Each nozzle 11 sprays its contents on row 41 in the manner described above for FIG. 1. Note how the leading portion of the water tube 31 wets row 41 before plume 35 contacts row 41. After plume 35 contacts row 41 and passes by, the trailing portion of each tube 31 flushes row 41.

Figure 4:
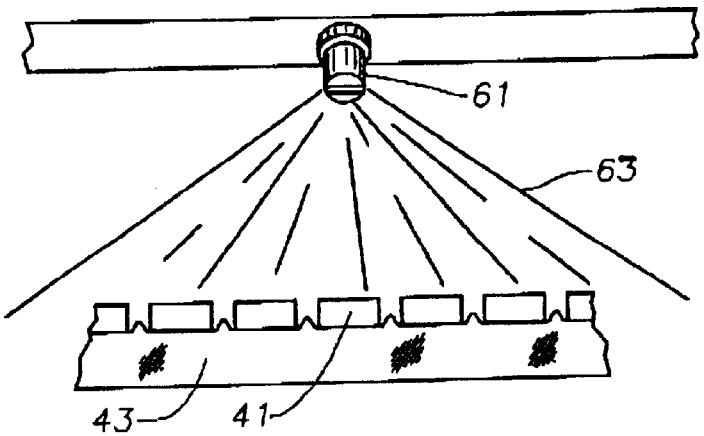
FIG. 4 is a schematic isometric view of a fan sprayer.

In the preferred embodiment, array 39 starts on one end of the first row 41 and linearly sweeps along its longitudinal axis 45 while spraying its contents. When the discharge of array 39 reaches the far end of the first row 41, array 39 returns to its starting point while continuing to discharge its contents and cleaning, again along axis 45. Nozzles 11 do not deviate from the orientation shown relative to each other or row 41. This discharge pattern cleans the first row 41. The second row 41 is then incremented by fixture 43 to the starting position in front of array 39 so that the second row 41 may be cleaned. The process continues, one row 41 at a time, until all of the rows 41 in fixture 43 are cleaned. As alluded to above, multiple banks or arrays 39 of nozzles 11 may be employed simultaneously to expedite the cleaning process of all the rows in fixture 43. After nozzles 11 pass by, a fan nozzle 61 (FIG. 4) applies a fan spray 63 of the solution in the range of 2 to 100 psig to the target as a final rinse. Ideally, fan spray 63 is applied at 60 psig and two to three liters per minute. Alternative cleaning subsystems, such as megasonic head cleaning, also may be utilized to remove residual contamination.

In addition, ESD-sensitive targets are also protected by grounding any operators of the equipment, grounding all fixturing, utilizing ionizers and other industry standard equipment and procedures. The tube of water 31 provides a shell around the dry matter of plume 35 to prevent electrical charge build-up or ESD damage during cleaning.

The invention has several advantages including the ability to clean the intricate, irregularly-shaped topography of magnetic head rows of all types of contamination including particulates, stains, adhesives, residual photo resist, laser slag, chemical, process, and environmental contamination. The cleaning occurs without direct contact while minimizing electrostatic discharge and corrosion of the product. This cleaning system combines the mechanical action of a brush cleaner without leaving the brush bristle material behind (especially on sharp edges). It also uses the concept of snow cleaning without generating particles of an uncontrolled size. In addition, the low pressure spray and fan sprayer flush away media and contamination from. the topographical patterns on the product without the risk of high pressure-induced damage to the product. The invention is also capable of very high throughput by loading multiple jobs in a step and repeat cleaner array.

While the invention has been shown or described in only some of its forms, it should be apparent to those skilled in the art that it is not so limited, but is susceptible to various changes without departing from the scope of the invention.

What is claimed is:

1. A cleaning system, comprising:

a media source containing a volume of dry media and having a media system for flowing the dry media;

a fluid source containing a reservoir of fluid and having an ESD-protective additive, a mixing system for injecting and metering the additive into the fluid, and a fluid discharge device for discharging the fluid;

a nozzle having an outer tube with a fluid inlet port connected to the fluid source, an inner tube with a media inlet port connected to the media source, the inner tube being mounted within the outer tube; and wherein the nozzle delivers two independent streams of discharge that are adapted to clean a target, including a hollow projection of fluid from the outer tube, and a plume of the dry media located within the hollow projection of fluid such that the dry media is free of mixing with the hollow projection of fluid during discharge from the nozzle prior to contacting the target.

2. The cleaning system of claim 1 wherein the dry media is pure bicarbonate of soda having a minimum purity of 99% with no flow aid.

3. A cleaning system, comprising:

a media source containing a volume of dry media and having a media system for flowing the dry media;

a fluid source containing a reservoir of fluid and having an ESD-protective additive, a mixing system for injecting and metering the additive into the fluid, and a fluid discharge device for discharging the fluid;

nozzle having an outer tube with a fluid inlet port connected to the fluid source, an inner tube with a media inlet port connected to the media source, the inner tube being mounted within the outer tube;

the nozzle delivers two independent streams of discharge that are adapted to clean a target, including a hollow projection of fluid from the outer tube, and a plume of the dry media located within the hollow projection of fluid such that the dry media is free of mixing with the hollow projection of fluid during discharge from the nozzle prior to contacting the target; and wherein the fluid in the fluid source is deionized fluid that is completely pre-mixed with the additive prior to discharge.

4. The cleaning system of claim 1 wherein the hollow projection of fluid is conical in shape with a central void and a generally annular cross-section, and wherein the plume is located within the central void.

5. The cleaning system of claim 1 wherein the plume is a substantially solid, conical dispersion of the dry media and has a generally circular cross-sectional shape.

6. The cleaning system of claim 1 wherein the tubes have distal ends that are concentric with each other.

7. The cleaning system of claim 1 wherein the system is a non-contact cleaner and a leading portion of the projection of fluid is adapted to wet the target before the plume contacts the target, and a trailing portion of the projection of fluid is adapted to flush the target after the plume contacts the target.

8. The cleaning system of claim 1 wherein the nozzle comprises an array of nozzles.

9. The cleaning system of claim 1, further comprising a fan sprayer for applying a final rinse of the fluid to the target.

10. A cleaning system, comprising:

a media source containing a volume of dry media and having a media system for flowing the dry media;

a fluid source containing a reservoir of deionized water and having a surfactant, a fluid system for injecting and metering the surfactant into the water, and a fluid discharge device for discharging the water;

an array of nozzles, each having an outer tube with a fluid inlet port connected to the fluid source, an inner tube with a media inlet port connected to the media source, the inner tube being mounted within the outer tube; wherein each of the nozzles delivers two independent streams of discharge that are adapted to clean a target, including a hollow, generally conical projection of water with a central void from the outer tube, and a generally conical plume of the dry media located within the projection of water; the cleaning system further comprising:

a sprayer that is adapted to apply a final rinse of the water to the target.

11.The cleaning system of claim 10 wherein dry media is pure bicarbonate of soda having a minimum purity of 99% with no flow aid.

12. The cleaning system of claim 10 wherein the system is a non-contact cleaner and a leading portion of the projection of water is adapted to wet the target before the plume contacts the target, and a trailing portion of the projection of water is adapted to flush the target after the plume contacts the target.

13. The cleaning system of claim 10 wherein the deionized water is completely pre-mixed with the surfactant prior to discharge and is discharged at a uniform controlled rate.

14. The cleaning system of claim 10 wherein the tubes have distal ends that are concentric with each other.

* * * * *